US010020612B2

(12) United States Patent
Chana et al.

(10) Patent No.: US 10,020,612 B2
(45) Date of Patent: Jul. 10, 2018

(54) METHOD FOR CONDITIONING A SECTION OF A MATING MEMBER

(71) Applicant: Siemens Aktiengesellschaft, Munich (DE)

(72) Inventors: Paul Chana, Wrexham (GB); Trevor Jones, Kendal (GB); Richard Lewin, Ulverston (GB); Christopher Plant, Lancaster (GB); Stephen Ward, Ulverston (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/311,896

(22) PCT Filed: May 8, 2015

(86) PCT No.: PCT/EP2015/060136
§ 371 (c)(1),
(2) Date: Nov. 17, 2016

(87) PCT Pub. No.: WO2015/185324
PCT Pub. Date: Dec. 10, 2015

(65) Prior Publication Data

US 2017/0093083 A1 Mar. 30, 2017

(30) Foreign Application Priority Data

Jun. 4, 2014 (EP) ..... 14171160

(51) Int. Cl.
*H01R 13/52* (2006.01)
*H01R 13/523* (2006.01)
(Continued)

(52) U.S. Cl.
CPC ..... *H01R 13/523* (2013.01); *H01R 13/5219* (2013.01); *H01R 13/53* (2013.01); *H01R 43/002* (2013.01)

(58) Field of Classification Search
CPC ..... H01R 13/523
(Continued)

(56) References Cited

U.S. PATENT DOCUMENTS 4,142,770 A 3/1979 Butler, Jr. et al.
4,373,767 A 2/1983 Cairns
(Continued)

FOREIGN PATENT DOCUMENTS

GB 1562685 A 3/1980
GB 2070348 A 9/1981

OTHER PUBLICATIONS

EP Search Report dated Nov. 6, 2014, for EP application No. 14171160.6.

(Continued)

*Primary Examiner* — Tho D Ta
(74) *Attorney, Agent, or Firm* — Beusse Wolter Sanks & Maire

(57) ABSTRACT

A method for conditioning at least a section of a mating member of a connector unit having the mating member and a corresponding receiving chamber with a cavity wall partially encasing a receiving cavity, including at least the steps of: using a mating force caused by a mate of the mating member and the receiving chamber to force an insulation medium housed in the receiving cavity of the receiving chamber to travel along a distribution path for the insulation medium, wherein the insulation medium exits the receiving cavity and re-enters the receiving cavity along the distribution path and conditioning at least the section of the mating member with the insulation medium while the insulation
(Continued)

medium is bypassing the section of the mating member due to the mate of the mating member and the receiving chamber.

14 Claims, 3 Drawing Sheets

(51) Int. Cl.
*H01R 13/53* (2006.01)
*H01R 43/00* (2006.01)

(58) Field of Classification Search
USPC ..... 439/275, 276, 936
See application file for complete search history.

(56) References Cited

U.S. PATENT DOCUMENTS

2003/0211768 A1* 11/2003 Cameron ..... E21B 17/028 439/191
2004/0266240 A1 12/2004 Abbey et al.
2006/0160430 A1* 7/2006 Siddiqi ..... H01R 13/523 439/700

OTHER PUBLICATIONS

International Search Report dated Jun. 23, 2015, for PCT application No. PCT/EP2015/060136.
IPRP (PCT/IPEA/416) dated Sep. 8, 2016, for PCT application No. PCT/EP2015/060136.

* cited by examiner

METHOD FOR CONDITIONING A SECTION OF A MATING MEMBER

CROSS REFERENCE TO RELATED APPLICATIONS

This application is the US National Stage of International Application No. PCT/EP2015/060136 filed 8 May 2015, and claims the benefit thereof. The International Application claims the benefit of European Application No. EP14171160 filed 4 Jun. 2014. All of the applications are incorporated by reference herein in their entirety.

FIELD OF INVENTION

The present invention relates to a method for conditioning at least a section of a mating member of a connector unit comprising the mating member and a corresponding receiving chamber with a cavity wall encasing a receiving cavity. Further, the present invention relates to the receiving chamber embodied to perform the inventive method, further to a connector part of a connector unit with a receiving chamber and to a use of the connector part in an undersea connector unit.

ART BACKGROUND

In the near future an increasing demand for communication over wide distances, especially for example between continents will be needed. Hence, infrastructures, like sea cables and connectors linking sea cables and modules, e.g. subsea modules, like transformers, pumps etc., that are located and operated error proof subsea will be essential. It is known to use an electrically female socket and an electrically male receptacle pin in subsea connectors. An internal of the socket is a controlled environment filled with electrically insulating insulation medium which will protect all of the key electrical features in the socket from the sea water. In contrast the receptacle pin can be exposed to sea water to an extended period of time which allows detritus to build up of the surface of the pin and the surface may be fully wetted with sea water.

To remove the majority of the detritus and water during a mate of the female socket and the receptacle pin it is currently known to use several seals and scraper seals. Unfortunately, they do not effectively remove all of the surface contamination. Any surface contamination which remains on the receptacle pin can create a weak link in the electrical insulation of the system and thus reduce the breakdown voltage of the mated connector by allowing electrical tracking or creepage along the surface of the receptacle pin. The result of this is that breakdown electrical stress of the surface is lower than would be expected for clean surfaces. This can result in failure of the connector or penetrator at an unacceptably low voltage.

In current connectors components with surfaces exposed to contaminations and thus subjected to creepage are long so that the electrical stresses are low enough that surface contamination is not likely to cause an electrical breakdown. Furthermore, natural diffusion processes will slowly spread contaminates throughout the bulk of insulating insulation medium and dispersed contaminates are less likely to initiate an electrical breakdown. However, for a high voltage connector design, following this approach would lead to relatively large, heavy and expensive components.

GB 1 562 685 A describes a connector unit comprising a mating member with male electrical contacts and a corresponding receiving chamber being filled with a liquid and comprising female electrical contacts. While inserting the mating member into the receiving chamber and contacting the electrical contacts the liquid flows from the receiving chamber into a reservoir.

U.S. Pat. No. 4,373,767 A discloses a connector unit comprising a first member and a second member. A contact pin of the first member can be inserted into a cavity of the second member. Said cavity is filled with a liquid. While inserting the contact pin into the cavity the liquid is displaced from the cavity into an interior bladder.

SUMMARY OF THE INVENTION

It is a first objective of the present invention to provide a method that allows effective conditioning and especially cleaning of the mating member and thus to provide a connector unit that can be operated reliably, safely and is less insusceptible to errors, in comparison to state of the art systems.

It is a further objective of the present invention to provide a receiving chamber for a connector unit that allows and supports the conditioning, respective cleaning, of the mating member in an effective and space saving manner.

It is still a further objective of the present invention to provide a connector part for a connector unit that is failure proof, reliable and that is small in size as well as light in weight and can be manufactured with low costs.

It is still another objective of the present invention to provide a use of the connector part that allows an application of the connector part that is subjected to high standard.

These objectives may be solved by a method, a receiving chamber, a connector part and a use according to the subject-matter of the independent claims.

According to a first aspect of the present invention, a method for conditioning at least a section of a mating member of a connector unit comprising the mating member and a corresponding receiving chamber with a cavity wall partially encasing a receiving cavity is provided.

It is proposed, that the method comprises at least the steps of: Using a mating force caused by a mate of the mating member and the receiving chamber to force an insulation medium housed in the receiving cavity of the receiving chamber to travel along a distribution path for the insulation medium, wherein the insulation medium exits the receiving cavity and re-enters the receiving cavity along the distribution path and conditioning at least the section of the mating member with the insulation medium while the insulation medium is bypassing the section of the mating member due to the mate of the mating member and the receiving chamber.

Due to the inventive matter, a safe, reliable and failure proof operation of the connector unit can be provided. Moreover, a chance of an unforeseen electrical breakdown due to a contaminated surface, especially of a creepage surface, can be reduced. Hence, a system with less electrical issues, compared with state of the art systems, may advantageously be provided. In addition, with this inventive concept the size and weight of the connector unit as well as the costs of the pieces and for an assembling can be reduced.

Further, the creepage surface and electrically stressed insulation medium are much cleaner when compared with current state of the art systems. In addition, any impurity in the insulation medium can be dispersed more evenly throughout the insulation medium by the mating process and much faster than by relying on the diffusion process like in current systems. Since the mating process drives the surface and insulation medium conditioning effect the conditioning flow and especially the cleaning flow, of the insulation medium will automatically adjust to the mating speed. Hence, a fast mating speed will include high flow rates which will in turn condition the surface faster. Additionally, by using the mating force as driving force for the insulation medium flow a special means for creating the flow of the insulation medium can be omitted, saving, space, mounting efforts and costs. Furthermore, an internal geometry of the receiving chamber can be optimised using computational dynamics to ensure that an optimal flow is created for any new connector design.

A further advantage of the used flow path is that a solid insulation surrounding the receiving chamber, which forms the bulk of the insulation between the high voltage and earthed parts of the connector part, does not need to be broken or drilled to create flow ports for the insulation medium. This is because the insulation medium can be directed to flow out of the open end of the connector part through which the mating member enters. This is an advantage as any insulation medium flow port through the solid insulation would be electrical weak points in the system.

Even if the terms "section, wall, cavity, insulation medium, path, aperture, channel, surface, property, contour, groove, region, opening, end, sleeve" (see also below) are used in the singular or in a specific numeral form in the claims and the specification the scope of the patent (application) should not be restricted to the singular or the specific numeral form. It should also lie in the scope of the invention to have more than one or a plurality of the above mentioned structure(s).

A connector unit is intended to mean a unit which physically connects at least two parts, like two cables, in particular subsea cables, or a cable with a—subsea—module (e.g. a transformer, a pump etc.) or a busbar inside of the module or two modules, respectively. Thus, it is advantageously a subsea connector unit. The connector unit may be used in any harsh environment and may be embodied as an electrical connector and/or penetrator or advantageously as a wet mateable connector/penetrator. Moreover, it is advantageously employed in a high voltage application.

Such a connector unit comprises at least a conductor part that helps to establish an electrical connection in a mated position of two connected parts, like two cables or a cable with a module. This conductor part may be a conductor pin, receptacle pin or male part of a connector or of a penetrator or a socket contact of a female part, plug or socket or connector body of a connector for contacting a conductor pin of a male part. Further, the connector unit comprises connector parts that are adapted to mate physically with each other and are for example embodied as a mating member or the male part and as a receiving chamber as a part of the female part. Thus, the connector part is embodied as the male part and/or as the female part.

Hence, the receiving chamber in the female socket is intended to mean a part of the connector unit with an opening, recess, bore or cavity to receive another part of the connector unit, like the mating member (conductor pin) or parts thereof. Moreover, in case of an embodiment of the connector unit as comprising a penetrator the mating member is permanently connected to a cable or a module via a housing. Thus, the mating member is intended to mean a part of the unit with a pin, extension or the like to engage or being inserted in the receiving chamber of the female socket or the cable or the module. The mating member and its corresponding part (receiving chamber of the female socket, cable or module) are intended to establish an electrical connection either in case of mating of the male and female parts or a permanent connection of the conductor pin with the cable or module. The female and male parts or the module each may be encased in a casing or an external of a cable.

In this context a cavity wall should be understood as a structure being arranged at at least one side of the cavity and advantageously at one axial side and around a circumference of the cavity. Moreover, "partially encase" is intended to mean that not the whole cavity is surrounded by the cavity wall but that at least one section or opening in the cavity wall provides access to the cavity. An insulation medium is intended to mean any substance feasible for a person skilled in the art, like a silicone gel, grease, oil or advantageously insulation medium. The insulation medium is used to protect and isolate internals and electrical contacts of e.g. the female part for example from salt water and debris as well as to support the mating of the female part with the male part of the connector unit. Thus, it has also lubricating properties. Moreover, the insulation medium may be also a compensation medium due to its ability to react to pressure or thermal expansion and contraction. The term "housed in" should be understood as stored in or located in or that the receiving chamber is filled with the insulation medium.

A "mating force" is intended to mean a force being applied or executed during the mate especially by the mating member and advantageously it is the pushing force of the mating member acting either directly or indirectly (e.g. via a shuttle piston of the female part) on the insulation medium. In this context a distribution path should be understood as a specially selected or embodied and predefined path for the insulation medium.

A "conditioning" should be understood as a changing, modifying or and especially as a cleaning of the section of the mating member and especially as a removing of contaminations on the section. The section of the mating member is advantageously a surface, especially a surface where creepage effects may occur or in short a creepage surface, wherein a creepage surface is a surface along which there is an electrical field. The section is advantageously not located at a tip of the mating member and/or it is advantageously not inserted in the receiving cavity of the receiving chamber. In other words, the section is advantageously positioned outside of the receiving cavity of the receiving chamber after the mate of the mating member and the receiving chamber. The term "while bypassing" should be understood as "travelling along and simultaneously contacting", wherein "contacting" should mean at least a physical contact or a physical interaction between the insulation medium and the section of the mating member.

In other words, the inventive method is the idea of making use of the insulation medium, which flows through the connector unit during the mate by displacing the insulation medium due to an ingress of the mating member in the receiving chamber to condition a section e.g. a creepage surface of the mating member.

Furthermore, it is provided that the method comprises the step of: Forcing due to the mate of the mating member and the receiving chamber the insulation medium from the receiving cavity to exit through at least one radial aperture in the cavity wall of the receiving chamber. Thus, a controlled exit of the insulation medium can be provided. Moreover, the method comprises the step of: Forcing due to the mate of the mating member and the receiving chamber the insulation medium to travel along at least one axial channel in an outer surface of the cavity wall of the receiving chamber. Due to this, the insulation medium flows along a defined, straight and direct path increasing the travel speed compared to an unrestricted flow path of the insulation medium.

Advantageously, the method comprises the step of: Forcing due to the mate of the mating member and the receiving chamber the insulation medium from at least one axial channel in an outer surface of the cavity wall of the receiving chamber to enter the receiving cavity through at least one radial aperture in the cavity wall of the receiving chamber. Consequently, a direct entry for the insulation medium can be provided. The first and the at last second aperture as well as the axial channel are all parts of the distribution path.

Advantageously, the method comprises the step of: Storing the insulation medium in a compensation volume in an electrically unstressed region of the connector unit after the conditioning of the section of the mating member. In other words, the majority of the insulation medium, which flows along the mating member, ends up in a compensation volume outside of the receiving chamber (socket contact) where there is no electrical stress. Since the insulation medium with the embedded or dissolved contaminations is stored inside the compensation volume in the mated state of the connector unit the contaminations or impurity in the insulation medium can dispersed more evenly throughout the insulation medium. This results in a homogenous insulation medium for the subsequent conditioning and/or cleaning step during the subsequent mate. Generally, the capacity of the insulation medium to "store" impurities is about 30 mate and demate cycles.

In an embodiment the method comprises the step of: Selecting a size and/or shape of at least one radial aperture in the cavity wall of the receiving chamber and/or a size and/or shape of an axial channel in an outer surface of the cavity wall of the receiving chamber and/or a size and/or shape of the cavity wall of the receiving chamber dependent on at least one physical property of the insulation medium. Thus, the construction of the used parts can be specifically selected or balanced in regard of the needs of the insulation medium or the characteristics of the mate. The physical property can be any parameter feasible for a person skilled in the art, like a flow rate, a density, a viscosity or a Reynolds number.

Furthermore, also a number of radial apertures and/or axial channel may be selected in dependency of at least one physical property of the insulation medium. The selection of the special embodiment(s) for a first structure of the above mentioned structures may be dependent on one or a group of physical properties of the insulation medium and in turn, the selection of the special embodiment(s) for another of the above mentioned structures may be dependent on another or a different group of physical properties of the insulation medium. Moreover, the properties or characteristics of the above mentioned structures may also be selected in view of a range of mating speeds which are likely for the mate.

According to a further aspect of the present invention, a receiving chamber of a connector unit with a mating member and the receiving chamber, comprising a receiving cavity and a cavity wall partially encasing the receiving cavity, is provided.

It is proposed, that an outer surface of the cavity wall comprises at least one channel extending in axial direction of the receiving cavity, a first radial aperture and at least a second radial aperture, wherein the first radial aperture is located at a first axial end of the at least one axial channel and wherein the at least second radial aperture is located at a second opposed from the first radial end located axial end of the at least one axial channel.

Due to the inventive construction, a safe, reliable and failure proof receiving chamber and connector unit can be provided. This reduces also the chance of an unforeseen electrical breakdown due to a contaminated surface, especially of a creepage surface. Hence, a system with less electrical issues, compared with state of the art systems, may advantageously be provided. Moreover, the size and weight of the connector unit as well as the costs of the pieces and for an assembling can be reduced.

Furthermore, the creepage surface and electrically stressed insulation medium are much cleaner when compared with current state of the art systems. Any impurity in the insulation medium can be dispersed more evenly throughout the insulation medium by the mating process and much faster than by relying on the diffusion process like in current systems. Since the mating process drives the surface and insulation medium conditioning effect the conditioning flow and/or cleaning flow of the insulation medium will automatically adjust to the mating speed. Hence, a fast mating speed will include high flow rates which will in turn condition the surface faster. Additionally, by using the mating force as driving force for the insulation medium flow a special means for creating the flow of the insulation medium can be omitted, saving, space, mounting efforts and costs. Furthermore, an internal geometry of the receiving chamber can be optimised using computational dynamics to ensure that an optimal flow is created for any new connector design.

A further advantage of the used flow path is that a solid insulation surrounding the receiving chamber, which forms the bulk of the insulation between the high voltage and earthed parts of the connector part, does not need to be broken or drilled to create flow ports for the insulation medium. This is because the insulation medium can be directed to flow out of the open end of the connector part through which the mating member enters. This is an advantage as any insulation medium flow port through the solid insulation would be electrical weak points in the system.

The first and second aperture may have any shape feasible for a person skilled in the art, like circular, rectangular, triangular, oval, egg-shaped etc. Advantageously it is circular to provide a smooth and homogeneous exit and entry. A radial aperture is intended to mean an aperture which allows a flow in radial direction.

It is further provided, that the outer surface of the cavity wall comprises a plurality of axial channels, providing a sufficient surface area to distribute the insulation medium quickly and even during a high velocity mate. Advantageously, the axial channels are homogeneously distributed along an outer contour and/or advantageously a circumference of the cavity wall. Hence, also the flow of insulation medium can be designed evenly.

According to a realisation of the invention the cavity wall comprises a plurality of first radial apertures (exit apertures) to allow a great amount of insulation medium to exit the receiving chamber simultaneously. Advantageously, the cavity wall comprises a plurality of at least second radial apertures (entry apertures) to quickly discharge a high amount of insulation medium from the channel(s). When both the first and the at least second radial aperture are embodied as a plurality of apertures an accumulation of insulation medium in the cannel(s) can be beneficially avoided.

Advantageously, the first radial apertures and/or the at least second radial apertures are homogeneously distributed along an outer contour and/or advantageously a circumference of the cavity wall. Thus, a risk of an accumulation of insulation medium at one circumferential region of the receiving cavity or the channel(s) can be minimised.

In a further embodiment of the invention a partitioning of the plurality of axial channels is equal or an integer multiple of a partitioning of the plurality of the first radial apertures and/or of the at least second radial apertures. This provides an especially homogeneous distribution of the insulation medium along the distribution path.

According to a realisation of the invention the outer surface of the cavity wall comprises at least one groove extending in circumferential direction of the cavity wall and wherein the first radial aperture is positioned at a bottom of the groove. With the help of the groove the insulation medium can be easily feed to the channel(s). Advantageously, the at least second radial aperture is positioned at a bottom of the groove. By means of the groove and the positioning of the aperture in it the insulation medium can be delivered constructively easy from the channel(s) to the aperture.

In a further realisation of the invention the surface of the cavity wall comprises a first and at least a second circumferential grooves, wherein the first circumferential groove is located at the first axial end of the at least one axial channel and wherein the at least second circumferential groove is located at the second opposed from the first radial end located axial end of the at least one axial channel and wherein the plurality of the first apertures is positioned in the first circumferential groove and the plurality of the second apertures is positioned in the at least second circumferential groove. Hence, a homogeneous distribution of the insulation medium can be realised.

In an advantageously embodiment of the invention the first radial aperture and the at least second radial aperture are located axially aligned towards each other. Thus, the flow of the insulation medium can be designed evenly. It is further provided, that the first radial aperture and the at least second radial aperture are arranged in an axial extension of a bottom of the axial channel allowing a straight and unhindered communication between the apertures and the axial channel.

According to an alternative embodiment the first radial aperture and the at least second radial aperture are arranged in circumferential direction offset from an axial extension of a bottom of the at least tone axial channel. In other words, the at least one axial channel comprises two radial maxima and one radial minimum located between the two maxima and wherein the first radial aperture and the at least second radial aperture are located axially aligned with one radial maxima of the at least one axial channel. Thus the apertures are positioned in a region of the cavity wall with a relatively thick wall thickness. This enables a high stability of the cavity wall in this region.

In a further embodiment it is provided, that the cavity wall comprises an axial end region being located at a receiving opening of the receiving cavity and wherein the axial end region comprises an annulus region with an inner diameter that is smaller than an inner diameter of the receiving chamber. Thus, in the mated state the annulus region is arranged with a clearance fit with the mating member providing a nozzle like configuration that enhances the velocity of the insulation medium. In the mated state the annulus region is positioned in flow direction before the section to be conditioned/cleaned or the creepage surface, respectively, and thus allowing an efficient conditioning, especially cleaning, of this section due to the enhanced velocity.

According to a still further aspect of the present invention, a connector part of a connector unit with a mating member comprising a first, a second and at least a third axial section, and with an inventive receiving chamber is provided.

It is proposed that after a mate of the mating member with the receiving chamber at least a first radial aperture in a cavity wall of the receiving chamber is located at an axial end of the first section of the mating member and wherein at least one axial channel in an outer surface of a cavity wall of the receiving chamber extends along the second and the at least third section of the mating member and wherein an at least second radial aperture in a cavity wall of the receiving chamber is located at an axial height where an axial end of the at least third section of the mating member, wherein the at the at least third section of the mating member comprises an insulating surface.

Due to the inventive construction, a safe, reliable and failure proof receiving chamber and connector unit can be provided. This reduces also the chance of an unforeseen electrical breakdown due to a contaminated surface, especially of a creepage surface. Hence, a system with less electrical issues, compared with state of the art systems, may advantageously be provided. Moreover, the size and weight of the connector unit as well as the costs of the pieces and for an assembling can be reduced.

Furthermore, the creepage surface and electrically stressed insulation medium are much cleaner when compared with current state of the art systems. Any impurity in the insulation medium can be dispersed more evenly throughout the insulation medium by the mating process and much faster than by relying on the diffusion process like in current systems. Since the mating process drives the surface and insulation medium conditioning effect the conditioning flow and especially the cleaning flow of the insulation medium will automatically adjust to the mating speed. Hence, a fast mating speed will include high flow rates which will in turn condition the surface faster. Additionally, by using the mating force as driving force for the insulation medium flow a special means for creating the flow of the insulation medium can be omitted, saving, space, mounting efforts and costs. Furthermore, an internal geometry of the receiving chamber can be optimised using computational dynamics to ensure that an optimal flow is created for any new connector design.

A further advantage of the used flow path is that a solid insulation surrounding the receiving chamber, which forms the bulk of the insulation between the high voltage and earthed parts of the connector part, does not need to be broken or drilled to create flow ports for the insulation medium. This is because the insulation medium can be directed to flow out of the open end of the connector part through which the mating member enters. This is an advantage as any insulation medium flow port through the solid insulation would be electrical weak points in the system.

The first section of the mating member is advantageously a tip out of a corrosion resistant material. The second section is advantageously a conducting portion, e.g. a copper section, to electrically contact the socket contact of the female part. The insulating surface of the third section is a creepage surface and the insulating surface may be out of any insulating material suitable for a person skilled in the art, and be for example a plastic material e.g. out of the polyaryletherketone (PAEK) family, like polyether ether ketone (PEEK) Epoxy family or the polyamide family (e.g. Nylon). The insulation may be a coating.

In a further advantageous realisation of the invention the cavity wall of the receiving chamber comprises an axial end region being located at an receiving opening of the receiving cavity and wherein the axial end region comprises an annulus region with an inner diameter that is selected in such a way that the mating member is arranged with a clearance fit in the annulus region during the mate of the mating member and the receiving chamber. This provides a nozzle like configuration to enhance the velocity of the insulation medium. Due to the positioning of the annulus region in flow direction before the section to be conditioned/cleaned or the creepage surface, respectively, an efficient conditioning and especially cleaning of this section due to the enhanced velocity is achieved.

According to a further aspect of the present invention the connector part comprises a sleeve encasing the receiving chamber and wherein at least one axial channel in an outer surface of a cavity wall of the receiving chamber is radially confined by an inner surface of the sleeve. Hence, the surface of the sleeve and the axial channel built a compensation volume. The sleeve is advantageously an insulating sleeve out of PEEK.

Advantageously, the inventive connector part is embodied as a female part of the connector unit. Due to this a reliable mating of the male and female part can be provided.

According to a still further aspect of the present invention a connector unit is provided that comprises a mating member and a connector part, wherein the connector part comprises a receiving chamber with a cavity wall partially encasing a receiving cavity, wherein an insulation medium is housed in the receiving cavity of the receiving chamber, and wherein the connector part further comprises a sleeve encasing the receiving chamber.

It is proposed that an outer surface of the cavity wall comprises at least one channel extending in axial direction (34) of the receiving cavity, a first radial aperture and at least a second radial aperture, wherein the first radial aperture is located at a first axial end of the at least one axial channel and wherein the at least second radial aperture is located at a second opposed from the first radial end located axial end of the at least one axial channel and wherein at least one axial channel in an outer surface of a cavity wall of the receiving chamber is radially confined by an inner surface of the sleeve.

According to a still further aspect of the present invention a use of the connector part in a subsea application is proposed. Hence, a reliable connector part can be applied in an environment where high security standards are essential.

The above-described characteristics, features and advantages of this invention and the manner in which they are achieved are clear and clearly understood in connection with the following description of exemplary embodiments which are explained in connection with the drawings.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
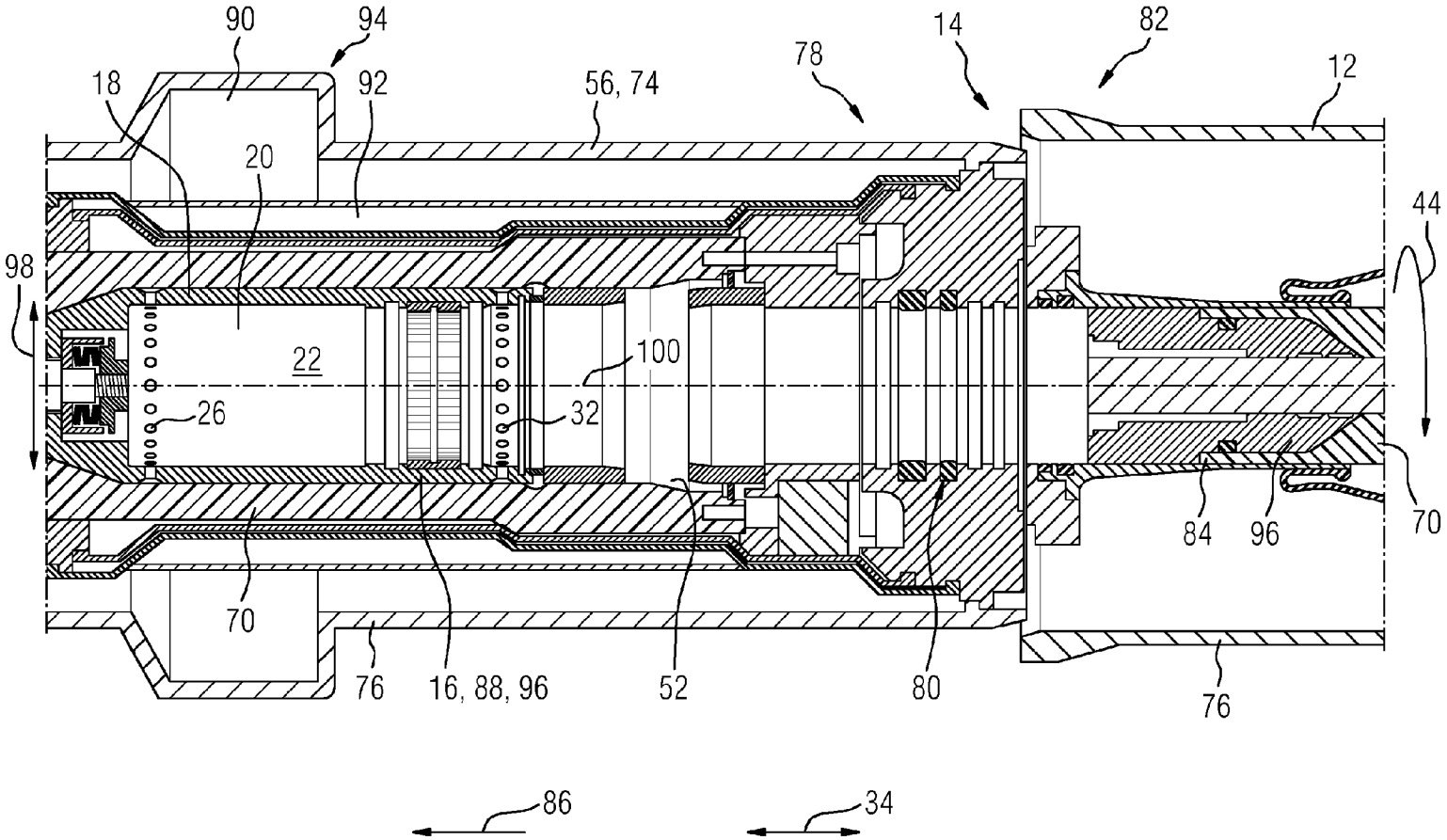
FIG. 1: shows schematically in a cross sectional view a subsea connector unit with a mating member and a receiving chamber of a female socket beforehand of mating.

The illustrations in the drawings are schematically. It is noted that in different figures, similar or identical elements are provided with the same reference signs.

FIG. 1 shows a high voltage subsea connector unit 14 for connecting two connected parts, like two subsea cables (not shown), wherein the connector unit 14 comprises two connector parts in the form of a mating member 12, a male part or a conductor pin 12 and a female part 74 or female socket 74. The female part 74 is a connector part 56 according to this invention and is intended for a use in a subsea application. Both the conductor pin 12 and the female socket 74 are each encased in a housing 76, which will be axially aligned during a mating or demating process of the mating member 12 and female part 74. The female socket 74 is located at a plug front end 78 of one subsea cable and comprises an axially receiving cavity 20 with seals 80 for preventing entering of water and dirt into internals of the female part 74. The mating member 12 is located at a receptacle front end 82 of the other subsea cable and comprises a receptacle pin assembly 84.

For a mating of the mating member 12 and female part 56 the receiving cavity 20 and the receptacle pin assembly 84 will be arranged axially aligned towards each other, so that by moving the receptacle pin assembly 84 in direction of the female part 76 or the moving direction 86, the receptacle pin assembly 84 can partially enter the receiving cavity 20 of the female part 76. Due to a proper positioning of the receptacle pin assembly 84 in the receiving cavity 20 of the female part 76 an electrical connection is established between the mating member 12 and a socket contact 88 of the female part 76.

Figure 2:
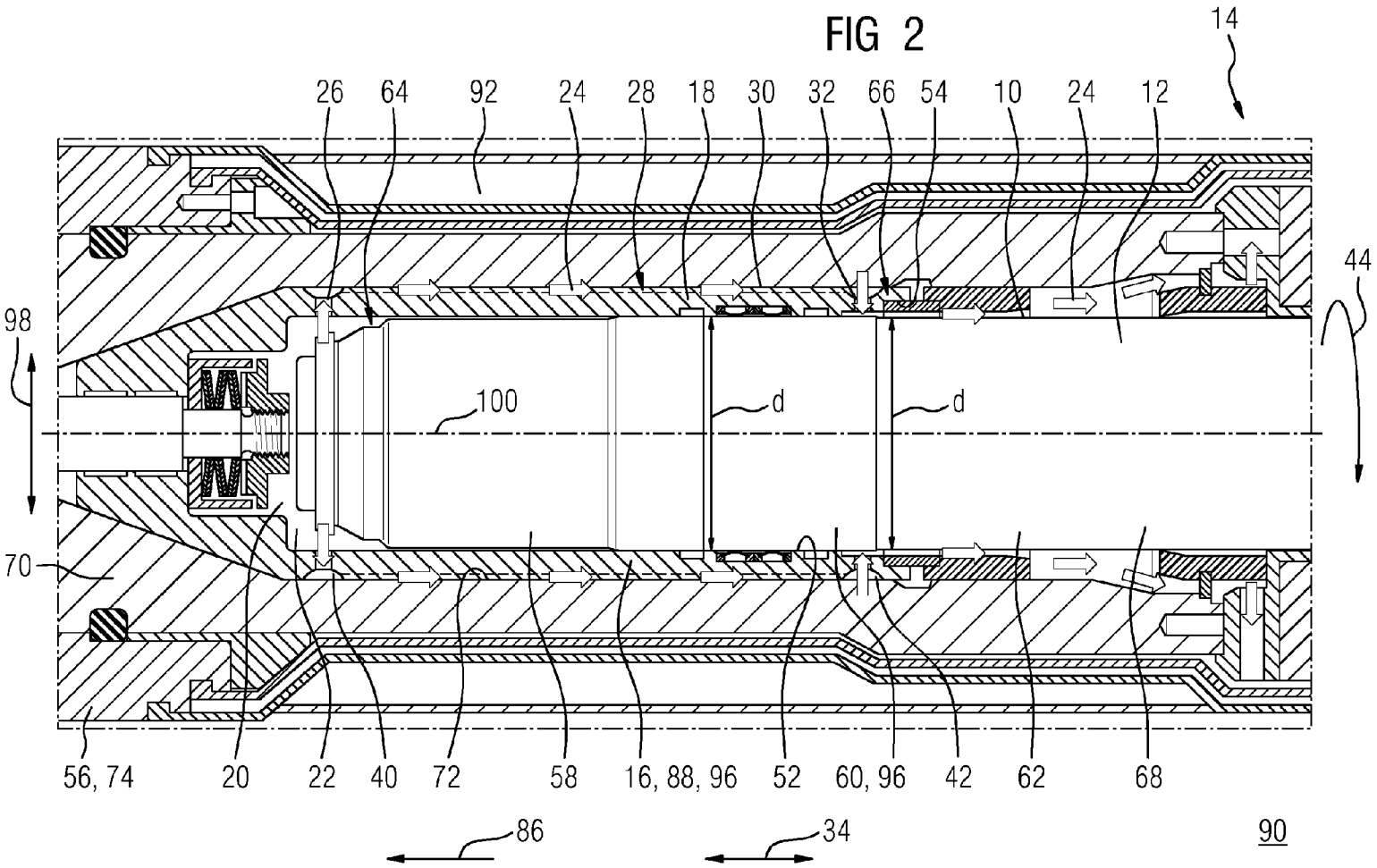
FIG. 2: shows schematically in a cross sectional view the subsea connector unit from FIG. 1 in a mated position with a distribution path for a insulation medium

To isolate the internals from the surrounding sea water, that can enter a section 90 of the female part 76, and to prevent sea water and debris to enter the receiving cavity 20 the receiving cavity 20 is filled with an insulation medium 22, like isolating insulation medium. Due to a pushing/mating force of the mating member 12 during the mate the insulation medium 22 is displaced from the receiving cavity 20 along a distribution path 24 (see FIG. 2) into a compensation volume 92 of the female part 76 (only schematically shown). The mated state is schematically shown in FIG. 2, which depicts a portion of the subsea connector unit 14 at a rear part 94 of the socket contact 88.

The mating member 12 and the female part 76 each comprise a current carrying component 96 out of copper in the form of a conductive core in the case of the mating member 12 and the socket contact 88 in the case of the female part 76. Moreover, both comprise an insulating sleeve 70 out of, for example, insulative polyether ether ketone (PEEK), in circumferential direction 44 around the current carrying component 96. In other words, the sleeve 70 of the female part 74 encases the receiving chamber 16.

The socket contact 88 is embodied as a receiving chamber 16 comprising the receiving cavity 20 and a cavity wall 18 partially encasing the receiving cavity 20. As stated above, the receiving cavity 20 is filled with the insulation medium 22 that travels the distribution path 24 caused by a mating force by the ingress of the mating member 12 in the receiving chamber 16 (see FIG. 2).

Figure 3:
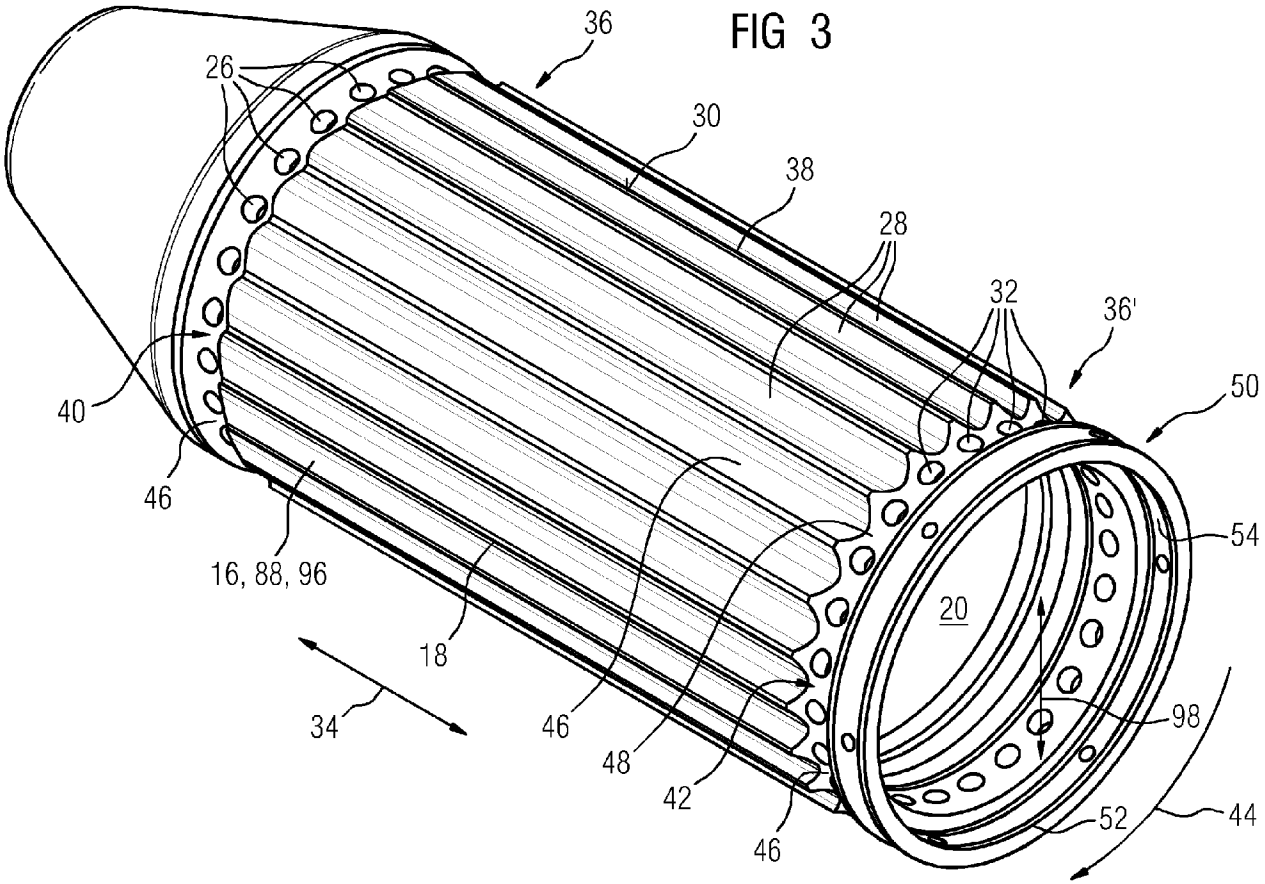
FIG. 3: shows a perspective view of the receiving chamber from FIG. 1.

As could be seen in FIG. 3, which shows a perspective view of the receiving chamber 16, the cavity wall 18 of the receiving chamber 16 comprises a plurality of first radial apertures 26 or exit apertures 26 extending in a radial direction 98 of the receiving chamber 16 and a plurality of second radial apertures 32 or entry apertures 32 to provide the distribution path 24 for the insulation medium 22. Moreover, an outer surface 30 of the cavity wall 18 comprises a plurality of axial channels 28 extending in parallel to an axis 100 of the connector unit 12. Further, the axial channels 28 are radially confined by an inner surface 72 of the sleeve 70. The axial channels 28, the exit apertures 26 and the entry apertures 32 are homogeneously distributed along an outer contour 38 or circumference of the cavity wall 18.

The first radial apertures 26 are positioned at a bottom 46 of a first circumferential groove 40 and the second apertures 32 are positioned at a bottom 46 of a second circumferential groove 42. The first groove 40 and thus the first radial apertures 26 are located at a first axial end 36 of the channels 28 and the second groove 42 and thus the second radial apertures 32 are is located at a second axial end 36' positioned opposed from the first radial end 36.

Furthermore, always a first radial aperture 26 and a second radial aperture 32 are located axially aligned towards each other. In respect to the channels 28 the first radial apertures 26 and the second radial apertures 32 are arranged in circumferential direction 44 offset from an axial extension 48 of a bottom 46 of the axial channels 28. A partitioning of the plurality of axial channels (28) is equal of a partitioning of the plurality of the first radial apertures 26 and of the second radial apertures 32.

To provide a clearance fit between the mating member 12 and the receiving chamber 16 during the mate or in the mated position the cavity wall 18 comprises an axial end region 50 being located at a receiving opening 52 of the receiving cavity 20 and wherein the axial end region 50 comprises an annulus region 54 with an inner diameter d that is smaller than an inner diameter d of the receiving chamber 16. Furthermore, the inner diameter d of the annulus region 54 is selected in such a way that the mating member 12 is arranged with the clearance fit in the annulus region 54 (see FIG. 2).

The mating member 12 comprises a first section 58 embodied as a corrosion resistant tip, a second section 60 embodied as the current carrying component 96 and third axial section 62, comprises an insulating surface 68 that can be subjected to creepage and is thus a creepage surface.

The dimensions of the parts of the mating member 12 and the receiving chamber 16 are selected in such a way that after the mate the first radial apertures 26 are located at an axial end 64 of the first section 58 of the mating member 12. Further, the axial channels 28 extend along the second and the third section 60, 62 of the mating member (12) and the second radial apertures 32 are located at an axial height where an axial end 66 of the third section 62 of the mating member 12 is positioned. Thus, the insulation medium 22 entering the space between the cavity wall 18 and the surface 68 through the enter apertures 32 travels along the surface 68.

The surface 68 is a section 10 of the mating member 12 that can be conditioned or cleaned by making use of the insulation medium 22 flowing through the connector unit 12 during the mate by displacing the insulation medium 22 due to an ingress of the mating member 12 in the receiving chamber 16.

Therefore the method for conditioning or cleaning, respectively, the section 10 comprises the steps of: —Using the mating force caused by the mate of the mating member 12 and the receiving chamber 16 to force the insulation medium 22 housed in the receiving cavity 20 of the receiving chamber 16 to travel along the distribution path 24 for the insulation medium 22, wherein the insulation medium 22 exits the receiving cavity 20 and re-enters the receiving cavity 20 along the distribution path 24 and specifically: —Forcing the insulation medium 22 from the receiving cavity 20 to exit through the first radial apertures 26 and—Forcing the insulation medium 22 to travel along the axial channels 28 in an outer surface 30 and—Forcing the insulation medium 22 from the axial channels 28 to enter the receiving cavity 20 through the second radial apertures 32 and thereby—Conditioning or cleaning, respectively, the section 10 with the insulation medium 22 while the insulation medium 22 is bypassing the section 10 due to the mate of the mating member 12 and the receiving chamber 16 and—Storing the insulation medium 22 in the compensation volume 92 in an electrically unstressed region of the connector unit 12 after the conditioning/cleaning of the section 10 of the mating member 12.

To customise the connector part 56 or the receiving chamber 16 to needs of special application a size and/or shape (e.g. an angle) of the radial apertures 26, 32 and/or a size and/or shape (e.g. an varying or increasing depth in axial direction 34) of the axial channels 28 and/or a size and/or shape of the cavity wall of the receiving chamber 16, like the inner diameter d, especially at the annulus region 54, may be selected in dependency of at least one physical property of the insulation medium 22, like a flow rate, a density, a viscosity or a Rayolds number.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

Although the invention is illustrated and described in detail by the preferred embodiments, the invention is not limited by the examples disclosed, and other variations can be derived therefrom by a person skilled in the art without departing from the scope of the invention.

The invention claimed is:

1. A method for conditioning a section of a mating member of a connector unit comprising the mating member and a corresponding receiving chamber comprising a cavity wall partially encasing a receiving cavity, the method comprising:

using a mating force caused by a mate of the mating member and the receiving chamber to force an insulation medium housed in the receiving cavity of the receiving chamber to travel along a distribution path for the insulation medium, wherein the insulation medium exits the receiving cavity and re-enters the receiving cavity along the distribution path, and conditioning the section of the mating member with insulation medium that has reentered the receiving cavity and is traveling along the distribution path and simultaneously contacting the section of the mating member due to the mate of the mating member and the receiving chamber.

2. The method according to claim 1, further comprising:

forcing due to the mate of the mating member and the receiving chamber the insulation medium from the receiving cavity to exit through at least one radial aperture in the cavity wall of the receiving chamber, and/or forcing due to the mate of the mating member and the receiving chamber the insulation medium to travel along at least one axial channel in an outer surface of the cavity wall of the receiving chamber, and/or forcing due to the mate of the mating member and the receiving chamber the insulation medium from the at least one axial channel in the outer surface of the cavity wall of the receiving chamber to enter the receiving cavity through the at least one radial aperture in the cavity wall of the receiving chamber.

3. The method according to claim 1, further comprising:

selecting a size and/or shape of at least one radial aperture in the cavity wall of the receiving chamber, and/or a size and/or shape of an axial channel in an outer surface of the cavity wall of the receiving chamber, and/or a size and/or shape of the cavity wall of the receiving chamber dependent on at least one physical property of the insulation medium.

4. A receiving chamber of a connector unit, comprising a receiving cavity and a cavity wall partially encasing the receiving cavity, wherein an outer surface of the cavity wall comprises at least one axial channel extending in axial direction of the receiving cavity, a first radial aperture and at least one second radial aperture, wherein the first radial aperture is located at a first axial end of at least one axial channel and wherein the at least one second radial aperture is located at a second axial end of the at least one axial channel opposed from the first axial end of the at least one axial channel, wherein the outer surface of the cavity wall comprises at least one groove extending in circumferential direction of the cavity wall, and/or wherein the first radial aperture is positioned at a bottom of the at least one groove, and/or wherein the at least one second radial aperture is positioned at a bottom of the at least one groove.

5. The receiving chamber according to claim 4, wherein the cavity wall comprises a plurality of first radial apertures, and/or a plurality of second radial apertures, and/or wherein the plurality of first radial apertures and/or the plurality of second radial apertures are homogeneously distributed along an outer contour of the cavity wall.

6. The receiving chamber according to claim 4, wherein the first radial aperture and the at least one second radial aperture are located axially aligned towards each other, and/or wherein the first radial aperture and the at least one second radial aperture are arranged in circumferential direction offset from an axial extension of a bottom of the at least one axial channel.

7. The receiving chamber according to claim 4, wherein the cavity wall comprises an axial end region being located at a receiving opening of the receiving cavity, and wherein the axial end region comprises an annulus region comprising an inner diameter that is smaller than an inner diameter of the receiving chamber.

8. The receiving chamber according to claim 4, wherein the outer surface of the cavity wall comprises a plurality of axial channels.

9. The receiving chamber according to claim 8, wherein a partitioning of the plurality of axial channels is equal to or an integer multiple of a partitioning of a plurality of first radial apertures and/or of a plurality of the at least one second radial apertures.

10. A connector part of the connector unit, comprising:

a mating member comprising a first axial section, a second axial section, and a third axial section, and the receiving chamber according to claim 4, wherein, after a mate of the mating member with the receiving chamber, the first radial aperture in the cavity wall of the receiving chamber is located at an axial end of the first axial section of the mating member, and wherein the at least one axial channel in the outer surface of the cavity wall of the receiving chamber extends along the second axial section and the third axial section of the mating member, and wherein the at least one second radial aperture in the cavity wall of the receiving chamber is located at an axial height where an axial end of the third axial section of the mating member is positioned, and wherein the third axial section of the mating member comprises an insulating surface.

11. The connector part according to claim 10, wherein the cavity wall of the receiving chamber comprises an axial end region being located at a receiving opening of the receiving cavity, and wherein the axial end region comprises an annulus region comprising an inner diameter that is selected in such a way that the mating member is arranged with a clearance fit in the annulus region during the mate of the mating member and the receiving chamber.

12. The connector part according to claim 10, further comprising:

a sleeve encasing the receiving chamber, wherein the at least one axial channel in the outer surface of the cavity wall of the receiving chamber is radially confined by an inner surface of the sleeve.

13. The connector part according to claim 10, wherein the connector part is adapted for use in a subsea application.

14. A connector unit comprising a mating member and a connector part, wherein the connector part comprises a receiving chamber comprising a cavity wall partially encasing a receiving cavity, wherein an insulation medium is housed in the receiving cavity of the receiving chamber, and wherein the connector part further comprises a sleeve encasing the receiving chamber, wherein an outer surface of the cavity wall comprises at least one axial channel extending in axial direction of the receiving cavity, a first radial aperture and at least one second radial aperture, wherein the first radial aperture is located at a first axial end of at least one axial channel and wherein the at least one second radial aperture is located at a second axial end of the at least one axial channel opposed from the first radial end of the at least one axial channel, and wherein the at least one axial channel in the outer surface of the cavity wall of the receiving chamber is radially confined by an inner surface of the sleeve, and wherein the connector unit further comprises a compensation volume in fluid communication with the receiving cavity via a distribution channel comprising the first radial aperture, the at least one axial channel, and the at least one second radial aperture, the compensation volume configured to receive and store insulation medium displaced from the receiving cavity during a mating of the connector unit.

* * * * *